US005390453A

United States Patent [19]

Untiedt

[11] Patent Number: 5,390,453

[45] Date of Patent: Feb. 21, 1995

[54] STRUCTURAL MEMBERS AND STRUCTURES ASSEMBLED THEREFROM

[76] Inventor: Dalmain Untiedt, 36 Houghton Drive, Houghton, Johannesburg, Transvaal Province, South Africa

[21] Appl. No.: 996,822

[22] Filed: Dec. 28, 1992

[30] Foreign Application Priority Data

Dec. 27, 1991 [ZA] South Africa ..... 91/10153
Feb. 11, 1992 [ZA] South Africa ..... 92/0973

[51] Int. Cl.[6] ..... E04B 7/02; E04C 3/00

[52] U.S. Cl. ..... 52/90.1; 52/478; 52/720; 52/730.4; 52/731.2; 52/732.1; 52/732.3; 52/735; 52/738; 52/775; 52/781

[58] Field of Search ..... 52/731.2, 731.7, 730.1, 52/730.4, 730.5, 730.6, 731.1, 731.3, 731.4, 731.5, 732.1, 732.2, 90.1, 90.2, 63, 222, 781, 737, 738, 720, 732.3; 135/119, 907, 908, 115, 102

[56] References Cited

U.S. PATENT DOCUMENTS

| | | | |
|---|---|---|---|
| 25,414 | 4/1896 | Jones | 52/720 |
| 1,778,337 | 10/1930 | Praty | 52/483 |
| 1,997,876 | 4/1935 | Sheldon | 52/731.2 |
| 2,539,038 | 1/1951 | Shumaker | 52/730.1 |
| 2,730,211 | 1/1956 | Findlay | 52/731.2 |
| 2,797,696 | 7/1957 | Friysche | 135/119 |
| 3,221,467 | 12/1965 | Henkels | 52/738 |
| 3,222,040 | 12/1965 | Eckert | 52/720 |
| 3,274,739 | 9/1966 | Gregoire | 52/282.1 |
| 3,295,267 | 1/1967 | Lundell | 52/222 |
| 3,420,016 | 1/1969 | Findlay | 52/731.5 |
| 4,092,992 | 6/1978 | Huddle | 52/732.1 |
| 4,590,727 | 5/1986 | Ghahremani et al. | 52/222 |
| 4,926,605 | 5/1990 | Milliken et al. | 52/222 |
| 5,004,001 | 4/1991 | Bouchard | 135/102 |
| 5,044,131 | 9/1991 | Fisher | 52/222 |
| 5,117,598 | 6/1992 | Livingston et al. | 52/222 |

FOREIGN PATENT DOCUMENTS

| | | | |
|---|---|---|---|
| 1355914 | 12/1964 | France | 160/392 |
| 396573 | 8/1933 | United Kingdom | 52/272 |

*Primary Examiner*—Michael Safavi
*Attorney, Agent, or Firm*—Banner, Birch, McKie and Beckett

[57] ABSTRACT

This invention is concerned with roofing structures utilizing a structural member formed from sheet metal to hollow triangular cross-section with a longitudinally extending outwardly opening narrow mouthed channel forming a peak along the member. The opposite end of the member will have outwardly projecting flanges around which may be engaged bent edges to a base plate. The channel is adapted to enable cladding sheets to have their edges engaged therein and thus provide a drip free roof.

9 Claims, 4 Drawing Sheets

STRUCTURAL MEMBERS AND STRUCTURES ASSEMBLED THEREFROM

This invention relates to structural members and structures assembled therefrom to form dwellings or roof structures for buildings. The structural member and the structures are particularly suited for low cost buildings but this invention is not confined to such use.

BACKGROUND OF THE INVENTION

One of the most expensive items on a building is the roof structure. Generally for permanent structures beam and rafter frameworks are used which require skilled labour both in their manufacture and in the erection of the roof structure. They are also an expensive component of the building particularly when related to the cost of a sub-economical dwelling for example. Frequently roof structures are over designed and the cost of materials used are out of proportion to the basic function and requirements of a roof. Also roof covering sheets are invariably perforated by fixing devices such as screws, bolts and nails thereby introducing a potential leak factor.

Further the fixing of ceilings and insulation under roofs is problematic requiring expertise and materials for effective fixing.

The roofing structures usually have structural members which are provided extensively for these structures and cannot be used otherwise in the complete building.

OBJECT OF THE INVENTION

It is an object of this invention to provide a versatile structural member which can be used in several different applications in the erection of a building. A further object of this invention is to provide an inexpensive roofing structure which can be easily installed without the use of skilled labour and to a large extent without the use of tools and fixing units.

SUMMARY OF THE INVENTION

According to this there is provided a hollow structural member comprising a sheet metal beam formed to provide a longitudinally extending peak with a channel opening at and extending along the peak and a base for securing the beam spaced from the peak.

The invention also provides for the channel to open through a narrow mouth, for the beam to be of generally triangular transverse cross-section, for the base to include outwardly directed longitudinally extending flanges and for ribs or lugs to be formed to extend outwardly closely adjacent the flanges.

Further features of the invention provide for the beam to be a roofing rafter with the ends shaped to engage panels forming facia panels and for the base to be resiliently compressible.

Still further features of this invention provide a roofing structure having rafters as above defined with the flanges resiliently engaged under lugs provided on supporting wall plates and deformed over the flanges to prevent release.

The roofing structure may be provided with roof cladding panels comprising sheet metal formed to have a series of ridges spaced apart and extending along the length of the sheet one edge of the sheet having an extension upwardly returned from the base of a ridge and the other inwardly bent from the base of a ridge.

A further feature of this invention provides for the return and the inwardly bent part to have clip formations formed thereon so that contiguous sheets can be resiliently engaged with each other.

The invention also provides for the formation to be a saw tooth configuration and for the inwardly bent portion to extend from the base of the upright side of the saw tooth.

The invention also provides a fastener having a shank with head and a rigid collar spaced apart a short distance from, and of smaller diameter than the head. The shank of the fastener may also have a bulbous portion in its length between the free end and the collar.

The invention also provides for the structural member to be rolled from sheet metal and to have a transverse plate fixed between the inner ends of the flanges and to include stiffeners secured to the inner walls extending between the peak and the base. These structural members may form columns to support cladding to form walls and may also provide frames for windows and doors.

BRIEF DESCRIPTION OF THE DRAWINGS

These and many other features of this invention will become apparent from the following descriptions of preferred embodiments of this invention in which reference is made to the accompanying drawings.

In the drawings

Figure 7:
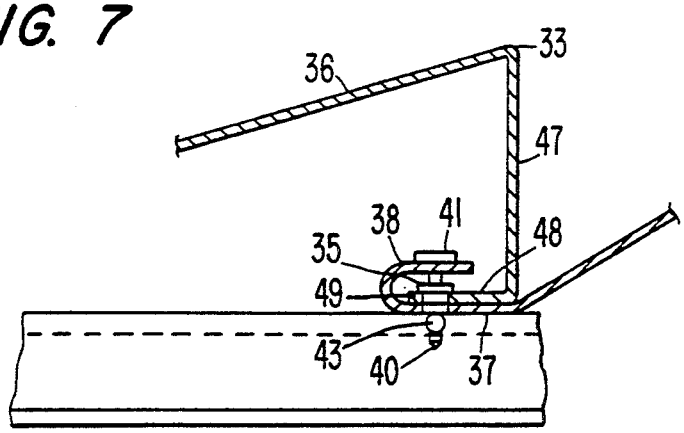
FIG. 7 shows a detail of the fixing of the cladding.
Figure 7A:
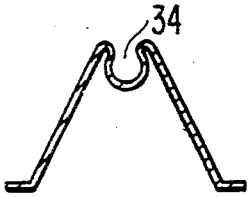

FIG. *7a* shows an end of the broken away underlying rafter shown in FIG. 7.

Figure 8:
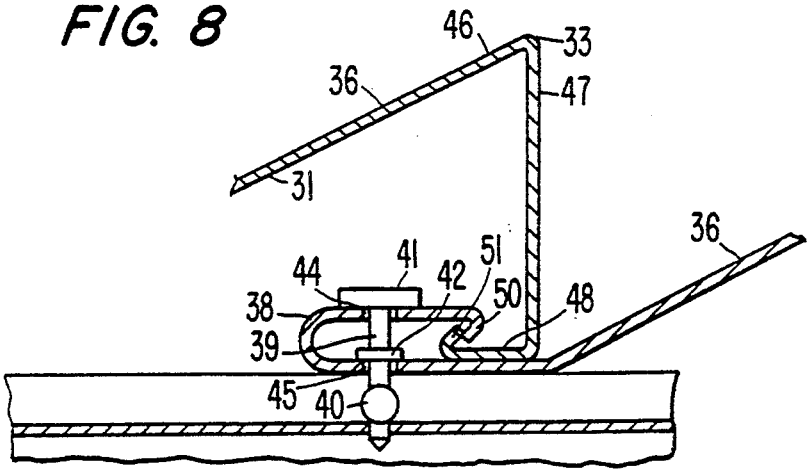
Figure 10:
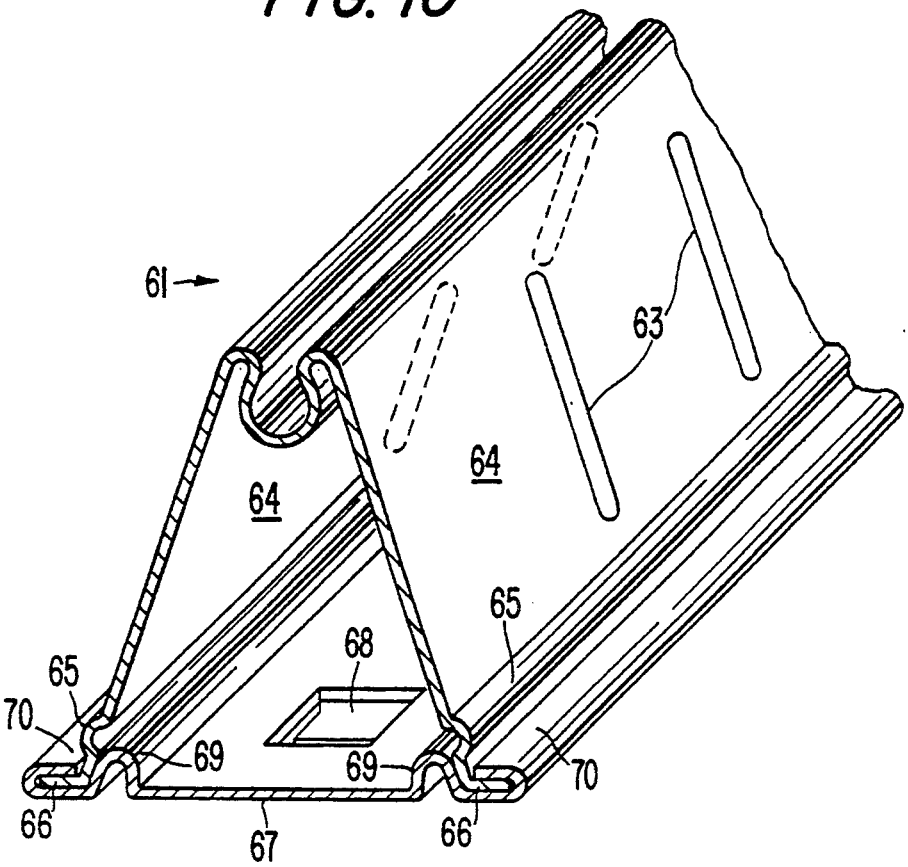
Figure 9:
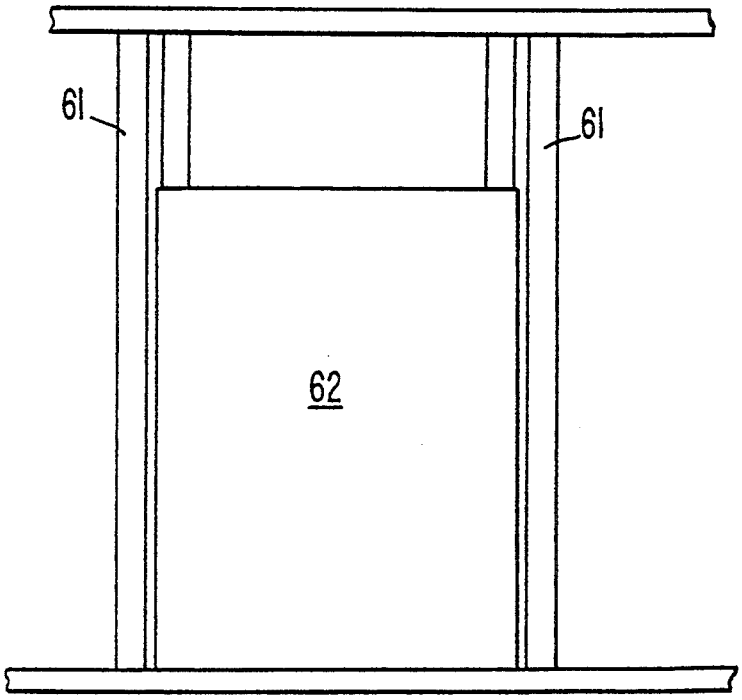

FIG. 8 shows an alternative method of fixing contiguous sheets of cladding;

FIG. 9 illustrates the structural member as a column to support a door frame;

FIG. 10 shows further details of a structural member.

DETAILED DESCRIPTION OF THE DRAWINGS

As illustrated in FIGS. 1 to 5 the structural member forms part of a roof structure which is suitable for use on low cost housing with the roof being inclined in one direction only.

Figure 1:
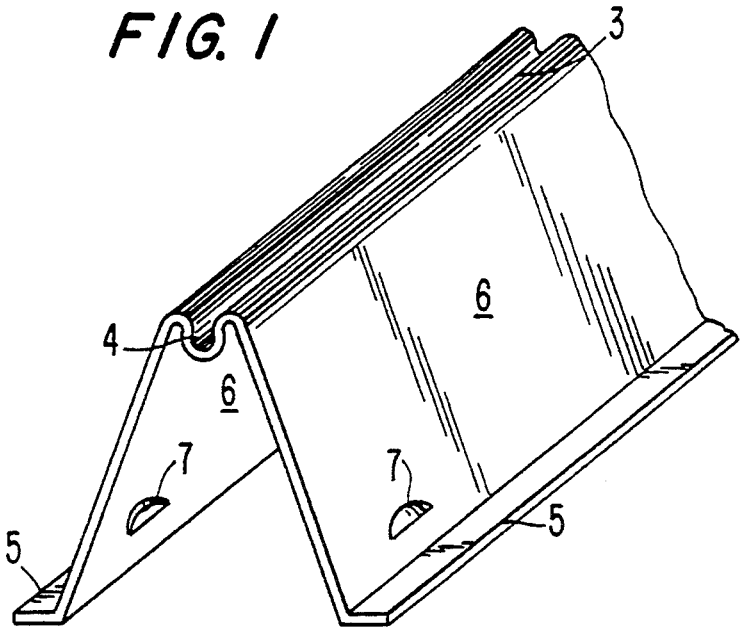
FIG. 1 shows an oblique view of an end of a rafter.

The structure has the structural member acting as rafters (2) in FIG. 1 each formed from rolled or pressed sheet metal to a generally triangular transverse cross-section. The peak (3) of the rafter is formed to provide drip free channel (4) extending along the length of the rafter. The base has outwardly extending flanges (5) and the side walls (6) of the rafter are inherently resiliently flexible towards each other.

Figure 3:
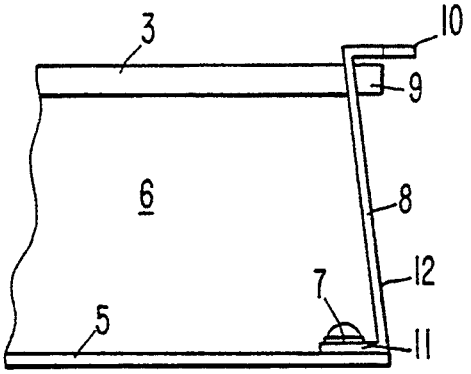
FIG. 3 illustrates the attachment of a facia panel.
Figure 4:
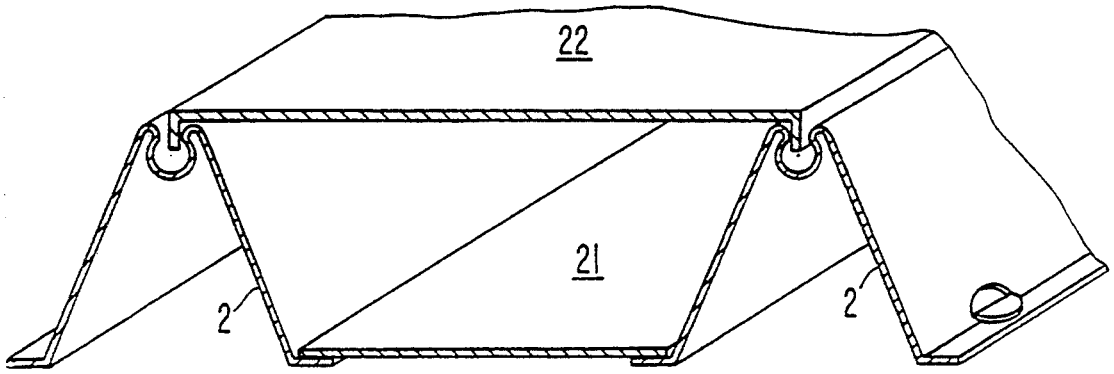
FIG. 4 shows a roof panel mounted between adjacent rafters.

Lugs (7) are pressed outwardly from the material of the walls (6) closely adjacent the flanges (5). As shown in FIG. 3 the ends of the rafters (2) are shaped to receive facia panels (8) and are inclined rearwardly from the base at the lower ends and forwardly at the higher ends. The channel (4) at the peak projects beyond the end of the rafter to form a pintle (9) which engages through an appropriate aperture formed in the facia panel (8).

The facia panel (8) is also formed from sheet metal bent to have oppositely directed flanges (10) and (11) along the top and bottom edges respectively. To attach the panel (8) to the ends of a series of rafters all that is necessary is for the flange (11) to be engaged between the flanges (5) of the rafters (2) and the lugs (7) adjacent the ends of the rafters. The rafters can conveniently be rolled from individual lengths of sheet metal with the ends cut to provide the appropriate shape to receive the facia panel.

The pintles (9) engage the appropriate apertures in the panel which is also provided with a series of ventilation openings (12). Flange 10 engages under the end of the roof panel.

The rafters (2) are carried by supporting beams (13) which in turn are secured to posts (14). Preferably the posts (14) are slotted adjacent these upper ends as indicated at (15) to receive the lower flange (16) of the beam (13) formed from sheet metal to channel section.

U-bolts (17) can conveniently be used to secure the beams (13) to posts (14) and the use of wing nuts on the bolts will avoid the necessity for spanners or other tools to secure the beams.

It will be appreciated that the beams referred to could be wall plates fixed to the tops of walls instead of being carried by posts.

Figure 2:
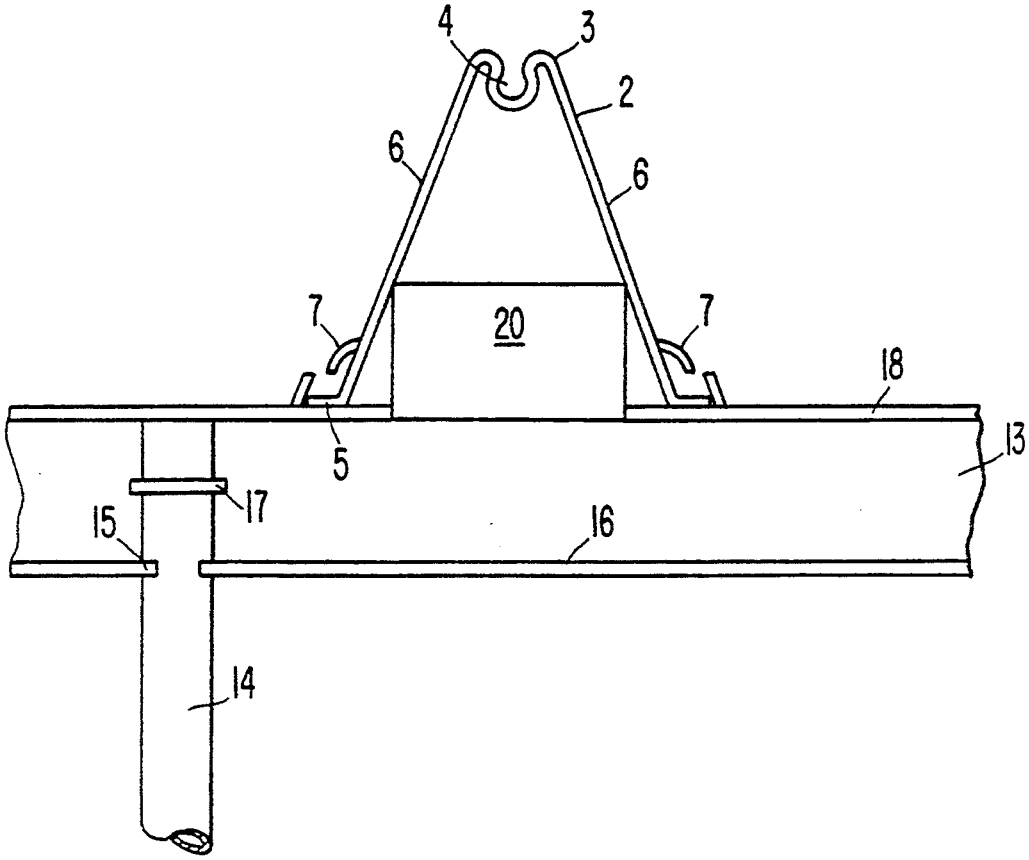
FIG. 2 an end view of the rafter engaged on a supporting beam.

Referring to FIG. 2 the underside of a rafter (2) is shown engaged on a supporting beam (13). The beam (13) has pressed from what in use is its upper flange (18) a pair of lugs (19). The flanges (5) on the rafter are resiliently engaged under the lugs (19) by flexing the walls (6) of the rafter (2) towards each other to permit the flanges to engage under the lugs and then allowing the walls to flex outwardly to secure flanges (5) under lugs (19).

Once this has been done a tongue (20) of material from the flange (18) is bent into the space between the walls (6) until the tongue contacts the walls. The rafters (2) are now locked to the beam (13).

The location of the lugs ( 19 ) on the supporting beams ( 13 ) and the apertures for the U-bolts ( 17 ) are predetermined and the beams prefabricated. This will ensure that the posts can be properly located and that the rafters ( 2 ) will be exactly spaced apart and be at right angles to the beams (13).

The pitch of the roof will be determined by the height of the posts at the respective ends of the rafters and a simple Jig can be provided to ensure the appropriate relationship.

From the above it will be seen that the erection of all the roof structure can be achieved without any sophisticated tools or labour. The configuration of the rafters and beams is such that high strength of the supporting structure can be achieved with a low weight of structural metal.

The flanges (5) enable preformed panels (21) of ceiling material to be inserted between the rafters (2) with the panel sizes predetermined by the length and spacing of the rafter. The provision of an integral flange on the rafter and the use of cardboard or other inexpensive heat insulating material for the provision of ceilings at low cost for low cost dwellings is a marked advantage over the roof structures presently available and ceilings with an insulating air space or space including insulating material between ceiling and roof panels makes conditions within the dwelling far more comfortable than where ceilings cannot be provided. The ceilings also facilitate containment of services such as plumbing and electricity.

The roofing panels (22) are also made from bent metal sheet to have downturned flanges around the edges. The longitudinal flanges on the panels (22) are cut away at each end for a length equivalent to the length of the upper flange (10) on the facia panels (8).

With the support structure assembled as above described all that is necessary is for the roofing panels (22) to be mounted thereon. This is easily accomplished by engaging the transverse flanges against the edges of the flanges (10) of the facia panels (8) and the longitudinal flange in the channels (4) extending along the peaks of the rafters.

It will be appreciated that the channels (4) are made part-circular in transverse cross-section so that there is a narrow opening into which flanges on abutting roof panels are inserted. The opening is made to a size which will ensure firm frictional engagement between the edges of the channel openings and the flanges and between the flanges themselves. The channel also forms a drain along the length of the rafter.

Figure 5:
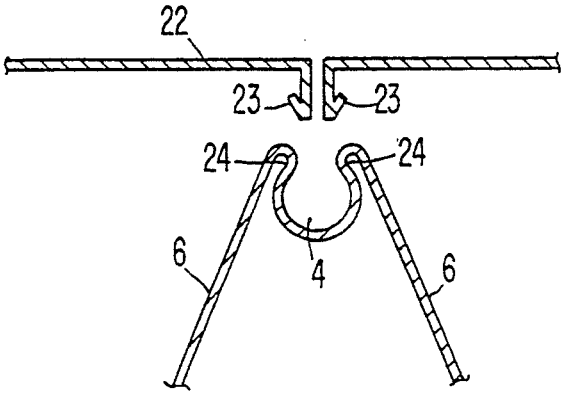
FIG. 5 is a detail.

Further it will be understood that the example above described may be modified to have the channel (4) designed as shown in FIG. 5 to receive the longitudinal flanges on the roof panels (22) illustrated in that figure. The ends (23) of the flanges are bent to project upwardly and outwardly to engage under lips (24) formed at the opening into the channel (4). This will lock the panels onto the rafter.

The above example has been described with the flanges (5) at the base of the rafter (2) being directed outwardly. It will be clear that the rafter (2) can have the flanges directed inwardly and the wall (6) flexed outwardly to enable the flanges to engage under appropriately positioned preformed lugs pressed from the body of the material of the support beam. In this embodiment a pair of tongues will be necessary, one on each side of the rafters, to provide the lock to prevent removal of the rafter.

Also under some circumstances it will be possible to provide the rafter shaped as a triangular cross-section. The apex will have a longitudinally extending slot to engage flanges on roofing panels and the whole rafter will act as the drainage channel referred to above. This rafter will require a different form of fixing to that described for rafters having separate flanges at the base.

The surfaces of the components may all be treated before erection of the roof structure to provide any desired protective and decorative finish.

From the above it will be appreciated that the simple design of a roof structure comprises four components being a beam which may be a wall plate, rafter, roof sheet and facia plates. No bolts, nuts or screws are required as all components clip and lock together forming a robust structure. The design separates the load bearing and covering function of materials resulting in substantial savings in costs of materials and erection. The roof structure is leakproof and provides attachment for insulation and ceilings.

Figure 6:
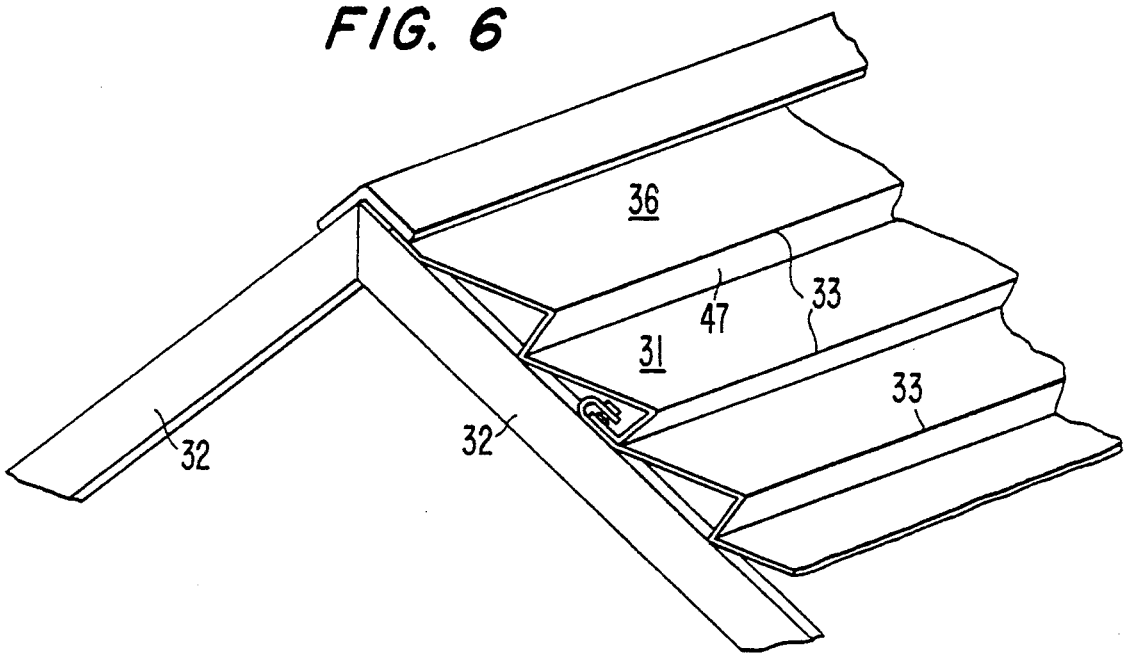
FIG. 6 shows an oblique view of part of a roof structure.

Referring now to FIGS. 6 to 8 an alternative structure is shown providing a pitched roof with cladding that can be made to resemble a tiled roof.

Referring now to FIGS. 6 to 8 an alternative structure is shown providing a pitched roof with cladding that can be made to resemble a tiled roof.

As shown roofing sheets (31) are formed to a saw tooth configuration along the length of the sheet. These sheets are then laid lengthwise across the rafters (32) to provide a series of ridges (33) across the roof which can be made to give a resemblance to a tiled roof.

It will be appreciated that the pitch of the saw teeth must be such that with the pitch of the rafters (32) these will nevertheless maintain a slope downwardly at all positions on the roof surface. The pitch of the roof may be 15° and the pitch of the saw teeth 7½ for example. Conveniently the roof structures may be of the kind described in my co-pending patent applications referred to above. Those structures use rafters (32) a detail of which is shown as part of FIG. 7. The peak of the rafter is formed to a drip channel with a narrow mouth (34) into which the fasteners (35) for the cladding (31) can be inserted.

The method and means whereby the contiguous sheets of the cladding (31) may be secured to each other and to the rafters (32) is shown in FIG. 7.

One edge of each sheet terminates in the inclined surface (36) of a saw tooth shape. This edge has an extension (37) which is returned upwardly at (38). Perforations are made through the return (38) and the extension (37) to receive the fastener (35).

The fastener (35) has a shank (39) terminating at one end in a sharpened point (40) and in a head (41) at the other. A rigid collar (42) is formed on the shank of smaller diameter than the head (41). The shank (39) has a bulbous portion (43) formed in its length between the end (40) and collar (42).

The perforation (44) through the return (38) is sufficiently large to enable the collar (42) to pass there through and the perforation (45) through extension (37) is small so that the passage of the shank therethrough will cause the metal of the roofing sheet to deform around the shank (39).

The bulbous portion (43) will pass into the drip channel at the peak of rafter (32) through the mouth (34) which will resiliently engage around the shank (39).

The opposite edge (46) of cladding (31) terminates in the vertical part (47) of the saw tooth shape and has an inwardly bent strip (48). This strip has apertures (49) which will also permit the passage of the shank (39) and collar (42) of the fastener (35).

As can be seen from FIG. 7 the inwardly bent strip (48) of a sheet of cladding (31) is located between the extension (37) and return (38) of a contiguous sheet. The strip (48) forms part of the strip which is higher up the pitch of the roof than the other sheet.

When the fasteners (35) are inserted at each rafter (32) the sheets are linked together and anchored to the rafters (32) to form a roof cladding.

In the alternative construction shown in FIG. 8 it is possible to secure a first sheet to the rafters and subsequently to resiliently clip the next contiguous sheet into position.

To enable this to be done the return (38) has its free end bent back inwardly to form a clip (50).

The end of the inwardly bent strip (48) is upwardly bent to form a clip (51) complimentarily shaped to the clip (50). There is no aperture (49) necessary.

The proportions of the clips (50) and (51) and their relation to the fastener (35) is such that the sheets can be flexed to enable the clips to be resiliently engaged to each other.

It will be appreciated that the cladding above described can be easily and accurately assembled without the necessity of skilled labour. The cladding can also be fixed in position in a short space of time.

FIG. 9 illustrates the structural member (61) used as vertical columns to which door frames (62) may be clipped in the manner described above for roofing panels.

FIG. 10 illustrates modification in details of the structural member (61). Stiffening ribs (63) are formed in or secured to the sides (64) of the members. Also ribs (65) are pressed from the sides adjacent the flanges (66) and these ribs locate ceiling panels as an alternative to lugs being pressed from the sheet material.

A base plate (67) which can be slid into position to span the bottom of the structural member (61) to give rigidity to the member when required. Attachment lugs (68) can be pressed from the plate (67) as shown and the plate can have locating ribs (69) and flanges (70) folded back on themselves to secure the sides of the member (61) against spreading under load.

The invention is not limited to the particular embodiments described above but may be varied in many respects without departing from the scope of the invention. For example the roofing panels can be varied with regard to materials used and the methods of securing the components may also be varied. It is however envisaged that such alternative forms will also ensure that minimum skills and equipment will be necessary to erect the roofing structures.

Also the structural members can serve other purposes than those described in the erection of buildings.

I claim:

1. A hollow structural member comprising a sheet metal beam formed with a generally triangular cross-sectional shape to provide a longitudinally extending peak, an inwardly extending channel with an opening at and extending along the peak, and having walls defining the sides and bottom of said channel to provide a narrow channel opening which expands beyond the opening into a wider space between the walls, and a base for securing the beam, said base lying in a plane generally parallel to and spaced from the bottom of the channel, said base being in the form of longitudinally extending outwardly directed flanges.

2. A hollow structural member as claimed in claim 1 in which ribs are provided on oppositely disposed sides of the triangular shaped beam adjacent the flanges.

3. A hollow structural member as claimed in claim 2 in which a base plate is provided secured between the sides with attachment lugs pressed from the base plate.

4. A hollow structural member as claimed in claim 2 forming a roofing rafter with one end shaped to receive a facia panel.

5. A roofing structure including rafters as claimed in claim 4 with the flanges resiliently engaged under lugs provided on supporting beams and deformed over the flanges to prevent release.

6. A roofing structure including rafters as claimed in claim 4 with bent edges on contiguous cladding panels engaged in the channels.

7. A roofing structure including rafters as claimed in claim 4 supporting sheet metal cladding panels having opposite edges and formed to have a series of saw tooth ridges spaced apart and extending along the length of the sheet, one edge of the sheet having an extension upwardly returned from an end of an inclined part of a ridge and the other edge of the sheet being inwardly bent from an end of an upright part of a ridge, and the cladding being secured to the rafters by fasteners engaging in the channels.

8. A roofing structure as claimed in claim 7 in which the returns and inwardly bent parts on the panels have clip formations formed thereon so that contiguous sheets can be resiliently engaged with each other.

9. A roofing structure as claimed in claim 8 wherein the panels are secured by fasteners having a shank with a free end, a head and a rigid collar spaced apart a short distance from the head and of smaller diameter than the head, the shank having a bulbous portion in the length between the free end and the collar, the fasteners being passed through the panels such that the bulbous portion is engaged in the rafter channels.

* * * * *